US012259137B2

(12) United States Patent
Salazar Lois et al.

(10) Patent No.: US 12,259,137 B2
(45) Date of Patent: Mar. 25, 2025

(54) COMBUSTOR SWIRLER TO DOME ATTACHMENT

(71) Applicant: General Electric Company, Schenectady, NY (US)

(72) Inventors: Gerardo Antonio Salazar Lois, West Chester, OH (US); Nicholas John Bloom, Maineville, OH (US); Daniel J. Kirtley, Blue Ash, OH (US); Shai Birmaher, Cincinnati, OH (US); Ryan Christopher Jones, West Chester, OH (US)

(73) Assignee: GENERAL ELECTRIC COMPANY, Evendale, OH (US)

( * ) Notice: Subject to any disclaimer, the term of this patent is extended or adjusted under 35 U.S.C. 154(b) by 0 days.

(21) Appl. No.: 17/499,083

(22) Filed: Oct. 12, 2021

(65) Prior Publication Data

US 2023/0112757 A1 Apr. 13, 2023

(51) Int. Cl.

| | |
|---|---|
| ***F23R 3/14*** | (2006.01) |
| ***F23R 3/00*** | (2006.01) |
| ***F23R 3/60*** | (2006.01) |

(52) U.S. Cl.

CPC ..... *F23R 3/60* (2013.01); *F23R 3/007* (2013.01); *F23R 3/14* (2013.01); *F23R 2900/00017* (2013.01)

(58) Field of Classification Search

CPC .... F23R 3/14; F23R 2900/00017; F23R 3/60; F23R 3/007; F23R 3/283; F23R 3/286

See application file for complete search history.

(56) References Cited

U.S. PATENT DOCUMENTS

| | | | | |
|---|---|---|---|---|
| 6,212,870 | B1 * | 4/2001 | Thompson | F23R 3/60 60/746 |
| 6,581,386 | B2 | 6/2003 | Young et al. | |
| 7,591,136 | B2 | 9/2009 | Bernier et al. | |
| 7,596,949 | B2 | 10/2009 | DeVane et al. | |
| 10,317,085 | B2 | 6/2019 | Hannwacker et al. | |
| 10,598,381 | B2 | 3/2020 | Drake et al. | |
| 2003/0061815 | A1 * | 4/2003 | Young | B23P 6/00 60/752 |

(Continued)

FOREIGN PATENT DOCUMENTS

EP 3022491 B1 10/2019

*Primary Examiner* — Thomas P Burke

(74) *Attorney, Agent, or Firm* — Venable LLP; Edward A. Kmett; Michele V. Frank

(57) ABSTRACT

A combustor for a gas turbine includes a ceramic matrix composite (CMC) dome including a swirler opening therethrough with a flare interface surface surrounding the swirler opening, a swirler assembly including (a) a secondary swirler having a threaded flare attachment portion, and (b) a flare having (i) a threaded secondary swirler attachment portion, and (ii) a dome interface wall that interfaces with the flare interface surface of the CMC dome, and a swirler-dome attachment member. The flare is connected to the secondary swirler via the threaded flare attachment portion and the threaded secondary swirler attachment portion, and the swirler-dome attachment member applies a force to the CMC dome to engage the dome interface wall and the flare interface surface so as to connect the CMC dome and the swirler assembly.

10 Claims, 12 Drawing Sheets

(56) References Cited

U.S. PATENT DOCUMENTS

| | | | | |
|---|---|---|---|---|
| 2007/0199329 | A1* | 8/2007 | Hernandez | F23R 3/60 60/746 |
| 2008/0202122 | A1* | 8/2008 | Guezengar | F23R 3/14 60/722 |
| 2016/0169521 | A1* | 6/2016 | Drake | F23R 3/14 29/889.22 |
| 2017/0248317 | A1* | 8/2017 | Hannwacker | F23R 3/14 |
| 2018/0320900 | A1 | 11/2018 | Duncan et al. | |
| 2019/0003711 | A1* | 1/2019 | Reynolds | F23R 3/283 |
| 2019/0086088 | A1* | 3/2019 | Stevens | F23R 3/50 |
| 2020/0063961 | A1* | 2/2020 | Jones | F23R 3/60 |
| 2021/0095711 | A1 | 4/2021 | Pinney | |
| 2021/0108799 | A1* | 4/2021 | Freeman | F23R 3/283 |

* cited by examiner

COMBUSTOR SWIRLER TO DOME ATTACHMENT

TECHNICAL FIELD

The present disclosure relates to a combustor swirler connected to a CMC (Ceramic Matrix Composite) dome in a gas turbine engine.

BACKGROUND

Some conventional gas turbine engines are known to include rich-burn combustors that typically use a metallic swirler assembly that is connected with a metallic dome structure. The metallic dome structure has been known to include a deflector wall on a combustion chamber side of the dome, where the deflector wall deflects heat generated in the combustor during combustion. Cooling holes are generally included through the dome structure so as to provide some surface cooling of the dome and the deflector wall. The metallic swirler assembly is generally brazed to, or welded to, the dome structure.

BRIEF DESCRIPTION OF THE DRAWINGS

Features and advantages of the present disclosure will be apparent from the following description of various exemplary embodiments, as illustrated in the accompanying drawings, wherein like reference numbers generally indicate identical, functionally similar, and/or structurally similar elements.

DETAILED DESCRIPTION

Features, advantages, and embodiments of the present disclosure are set forth or apparent from a consideration of the following detailed description, drawings, and claims. Moreover, it is to be understood that the following detailed description is exemplary and intended to provide further explanation without limiting the scope of the disclosure as claimed.

Various embodiments are discussed in detail below. While specific embodiments are discussed, this is done for illustration purposes only. A person skilled in the relevant art will recognize that other components and configurations may be used without departing from the spirit and scope of the present disclosure.

As used herein, the terms "first", "second", and "third" may be used interchangeably to distinguish one component from another and are not intended to signify location or importance of the individual components.

The terms "upstream" and "downstream" refer to the relative direction with respect to fluid flow in a fluid pathway. For example, "upstream" refers to the direction from which the fluid flows, and "downstream" refers to the direction to which the fluid flows.

The implementation of non-metallic materials in combustors is becoming more prevalent. In particular, the implementation of Ceramic Matrix Composite (CMC) materials can be used to form the dome structure, rather than utilizing the conventional metallic dome structures. The CMC materials have better thermal capabilities than do the conventional metallic materials, and, as a result, less cooling is required for a CMC dome than is required for the conventional metallic dome. The less cooling needed for the dome means that more air is available for other purposes, including being used as dilution air. In addition, the CMC dome structure does not require a deflector wall, thereby reducing the overall axial length of the dome, which also reduces the length of the combustor module. The implementation of the CMC dome with a metallic swirler, however, presents a challenge as to the ability to connect the metallic swirler to the CMC dome. The present disclosure provides a threaded sandwich-type connection between component parts of the swirler and the CMC dome to connect the swirler assembly to the CMC dome.

Figure 1:
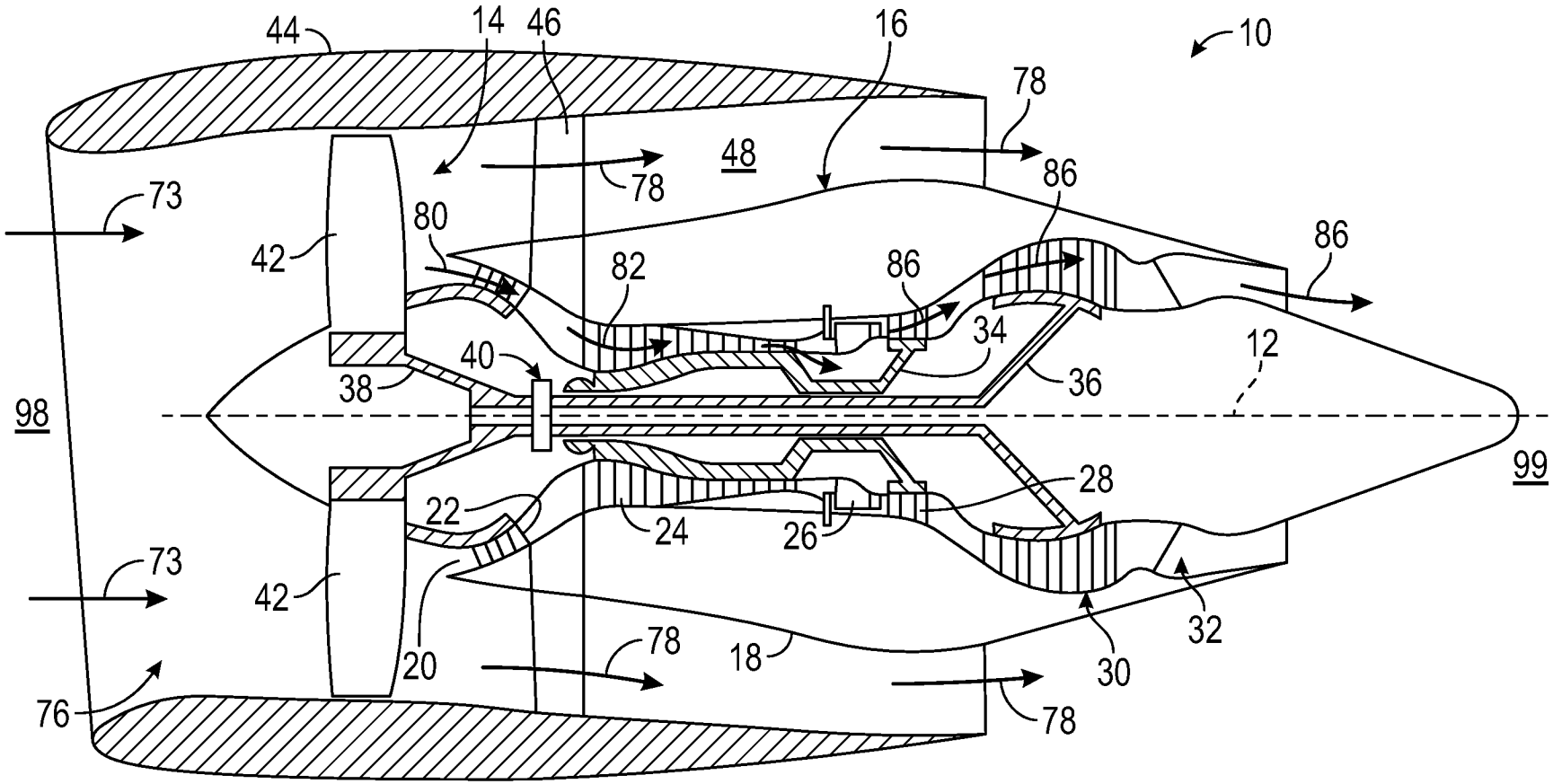
FIG. 1 is a schematic partial cross-sectional side view of an exemplary high by-pass turbofan jet engine, according to an aspect of the present disclosure.

Referring now to the drawings, FIG. 1 is a schematic partial cross-sectional side view of an exemplary high by-pass turbofan jet engine 10, herein referred to as "engine 10," as may incorporate various embodiments of the present disclosure. Although further described below with reference to a ducted turbofan engine, the present disclosure is also applicable to turbomachinery in general, including turbojet, turboprop, and turboshaft gas turbine engines, including marine and industrial turbine engines and auxiliary power units. In addition, the present disclosure is not limited to ducted fan type turbine engines such as that shown in FIG. 1, but can be implemented in unducted fan (UDF) type turbine engines. As shown in FIG. 1, engine 10 has an axial centerline axis 12 that extends therethrough from an upstream end 98 to a downstream end 99 for reference purposes. In general, engine 10 may include a fan assembly 14 and a core engine 16 disposed downstream from the fan assembly 14.

The core engine 16 may generally include an outer casing 18 that defines an annular inlet 20. The outer casing 18 encases, or at least partially forms, in serial flow relationship, a compressor section (22/24) having a booster or low pressure (LP) compressor 22, a high pressure (HP) compressor 24, a combustor 26, a turbine section (28/30) including a high pressure (HP) turbine 28 and a low pressure (LP) turbine 30, and a jet exhaust nozzle section 32. A high pressure (HP) rotor shaft 34 drivingly connects the HP turbine 28 to the HP compressor 24. A low pressure (LP) rotor shaft 36 drivingly connects the LP turbine 30 to the LP compressor 22. The LP rotor shaft 36 may also be connected to a fan shaft 38 of the fan assembly 14. In particular embodiments, as shown in FIG. 1, the LP rotor shaft 36 may be connected to the fan shaft 38 by way of a reduction gear 40, such as in an indirect-drive or a geared-drive configuration. In other embodiments, although not illustrated, the engine 10 may further include an intermediate pressure (IP) compressor and a turbine rotatable with an intermediate pressure shaft.

As shown in FIG. 1, the fan assembly 14 includes a plurality of fan blades 42 that are coupled to, and extend radially outwardly from, the fan shaft 38. An annular fan casing or nacelle 44 circumferentially surrounds the fan assembly 14 and/or at least a portion of the core engine 16. In one embodiment, the nacelle 44 may be supported relative to the core engine 16 by a plurality of circumferentially spaced outlet guide vanes or struts 46. Moreover, at least a portion of the nacelle 44 may extend over an outer portion of the core engine 16 so as to define a bypass airflow passage 48 therebetween.

Figure 2:
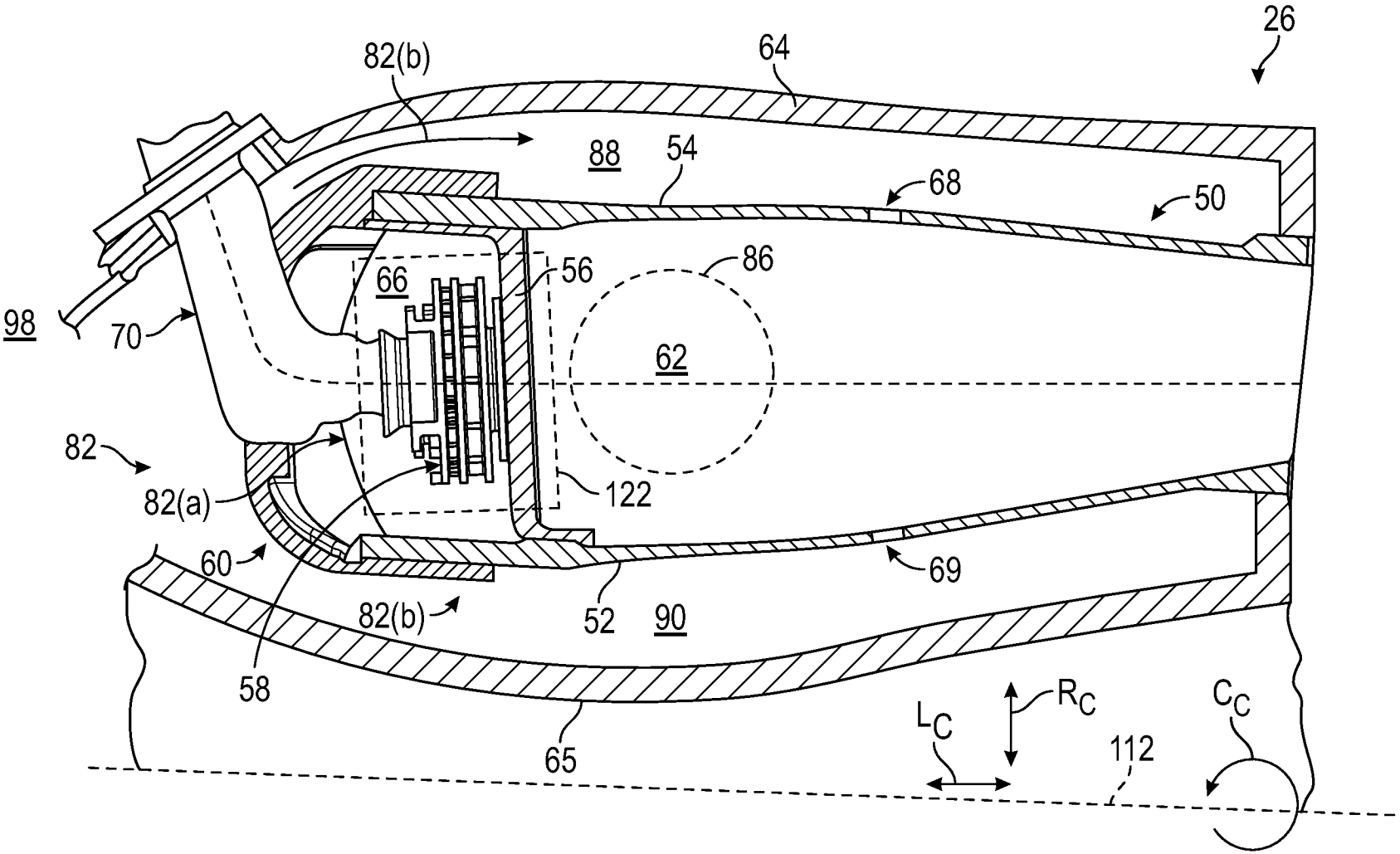
FIG. 2 is a partial cross-sectional side view of an exemplary combustor, according to an aspect of the present disclosure.

FIG. 2 is a cross-sectional side view of an exemplary combustor 26 of the core engine 16 as shown in FIG. 1. FIG. 2 depicts a combustor axial centerline 112 that may generally correspond to the engine axial centerline axis 12. Thus, the combustor 26 of FIG. 2 defines a combustor longitudinal direction (Lc) corresponding to the combustor axial centerline 112, a combustor radial direction (Rc) extending outward from the combustor axial centerline 112, and a combustor circumferential direction (Cc) extending circumferentially about the combustor axial centerline 112. As shown in FIG. 2, the combustor 26 may include a cowl 60, and a combustor liner 50, having an inner liner 52 and an outer liner 54. Each of the inner liner 52 and the outer liner 54 are annular liners that extend circumferentially about the combustor axial centerline 112. A Ceramic Matrix Composite (CMC) dome 56 extends in the combustor radial direction Rc between the inner liner 52 and the outer liner 54, and also extends circumferentially about the combustor axial centerline 112. Together, the inner liner 52, the outer liner 54, and the CMC dome 56 define a combustion chamber 62 therebetween. In the combustion chamber 62, an initial chemical reaction of an ignited fuel-oxidizer mixture injected into the combustion chamber 62 by a swirler assembly 58 may occur to generate combustion gases 86. The combustion gases 86 then flow further downstream into the HP turbine 28 and the LP turbine 30.

The combustor 26 further includes an outer casing 64 that extends circumferentially about the combustor axial centerline 112, and an inner casing 65 that also extends circumferentially about the combustor axial centerline 112. An outer flow passage 88 is defined between the outer casing 64 and the outer liner 54, and an inner flow passage 90 is defined between the inner casing 65 and the inner liner 52. The outer liner 54 may also include a plurality of outer liner dilution openings 68 that are circumferentially spaced around the outer liner 54. Similarly, the inner liner 52 may include a plurality of inner liner dilution openings 69 that are circumferentially spaced around the inner liner 52.

Referring back to FIG. 1, in operation, air 73 enters the nacelle 44 at a nacelle inlet 76, and a portion of the air 73 enters the compressor section (22/24) as a compressor inlet air flow 80, where it is compressed. Another portion of the air 73 enters the bypass airflow passage 48, thereby providing a bypass airflow 78. In FIG. 2, compressed air 82 from the compressor section (22/24) enters the combustor 26 via a diffuser (not shown). A portion of the compressed air 82(*a*) enters the cowl 60 into a pressure plenum 66, while another portion of the compressed air 82(*b*) passes to the outer flow passage 88 and to the inner flow passage 90. The compressed air 82(*a*) in the pressure plenum 66 passes through the swirler assembly 58 to mix with fuel injected by a fuel nozzle assembly 70, and a fuel-air mixture injected by the swirler assembly 58 into the combustion chamber 62 is ignited to generate combustion gases 86. A portion of the compressed air 82(*b*) in the outer flow passage 88 may be used as dilution air provided to the combustion chamber 62 through the plurality of outer liner dilution openings 68, and another portion of the compressed air 82(*b*) in the inner flow passage 90 may also be used as dilution air provided to the combustion chamber 62 through the plurality of inner liner dilution openings 69.

Figure 3:
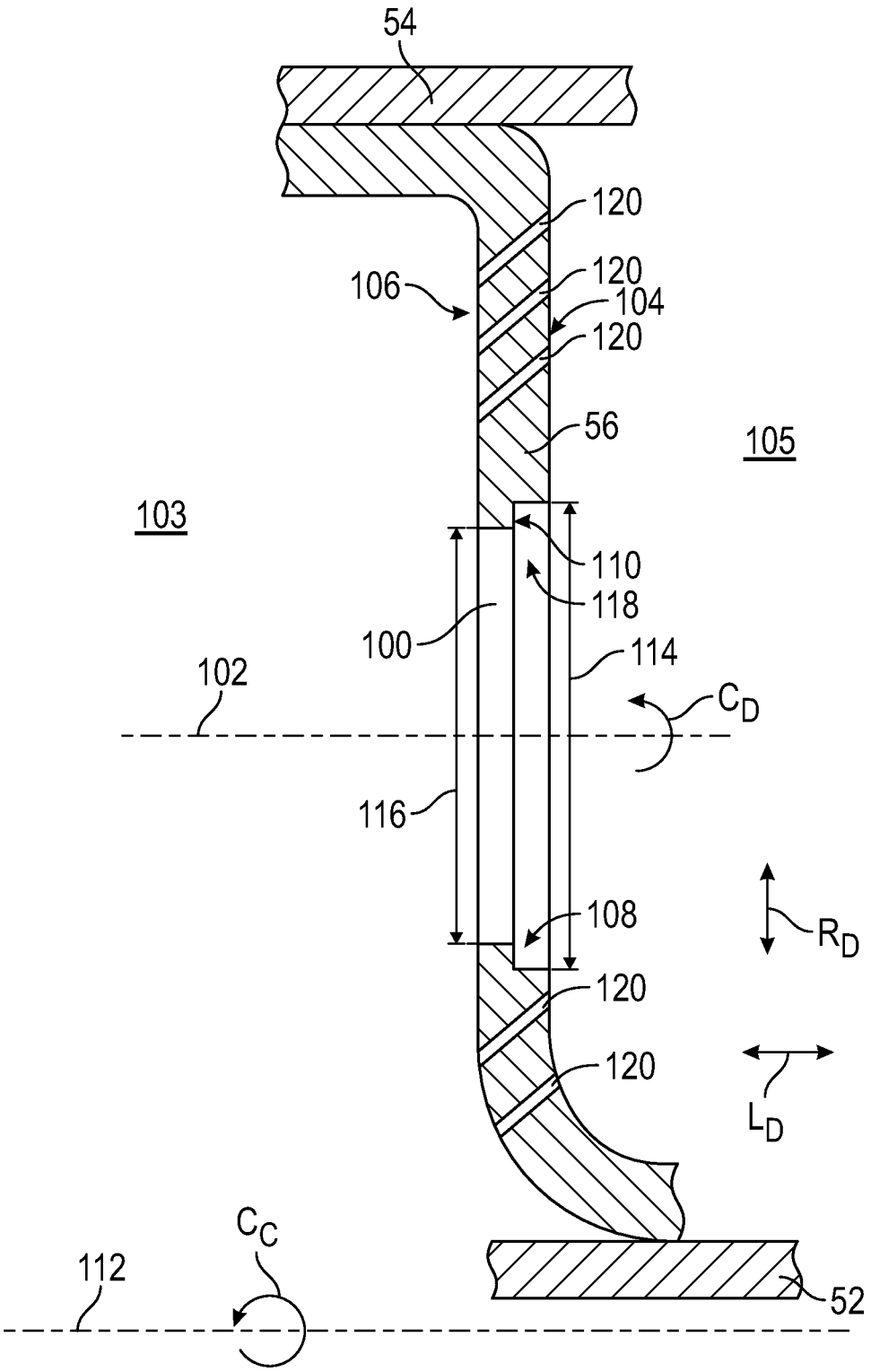
FIG. 3 is a partial cross-sectional side view of an exemplary CMC dome structure, according to an aspect of the present disclosure.

FIG. 3 depicts a partial cross-sectional view of the CMC dome 56, according to an aspect of the present disclosure. The CMC dome 56, as was mentioned above, extends circumferentially (Cc) about the combustor axial centerline 112. The CMC dome 56 is suitably connected (connection not shown) to the outer liner 54 and to the inner liner 52. The CMC dome 56 includes a swirler opening 100 through the CMC dome 56, where the swirler opening 100 has a CMC opening centerline 102 therethrough that defines a CMC dome upstream direction 103 and a CMC dome downstream direction 105. The CMC opening centerline 102 defines a CMC opening longitudinal direction (LD), a CMC opening radial direction (RD) extending outward from the CMC opening centerline 102, and a CMC opening circumferential direction (CD) extending circumferentially about the CMC opening centerline 102.

The CMC dome 56 defines a downstream surface 104 and an upstream surface 106. A recess 108 extends in the upstream direction 103 from the downstream surface 104 and is provided on the downstream side of the swirler opening 100. The recess 108 has a diameter 114 that is greater than a diameter 116 of the swirler opening 100, and defines a shoulder 110 extending radially outward from the swirler opening 100. The shoulder 110 may also be referred to as a flare interface surface 118 which surrounds the swirler opening 100. The CMC dome 56 may also include a plurality of cooling passages 120 extending through the CMC dome 56.

Figure 4:
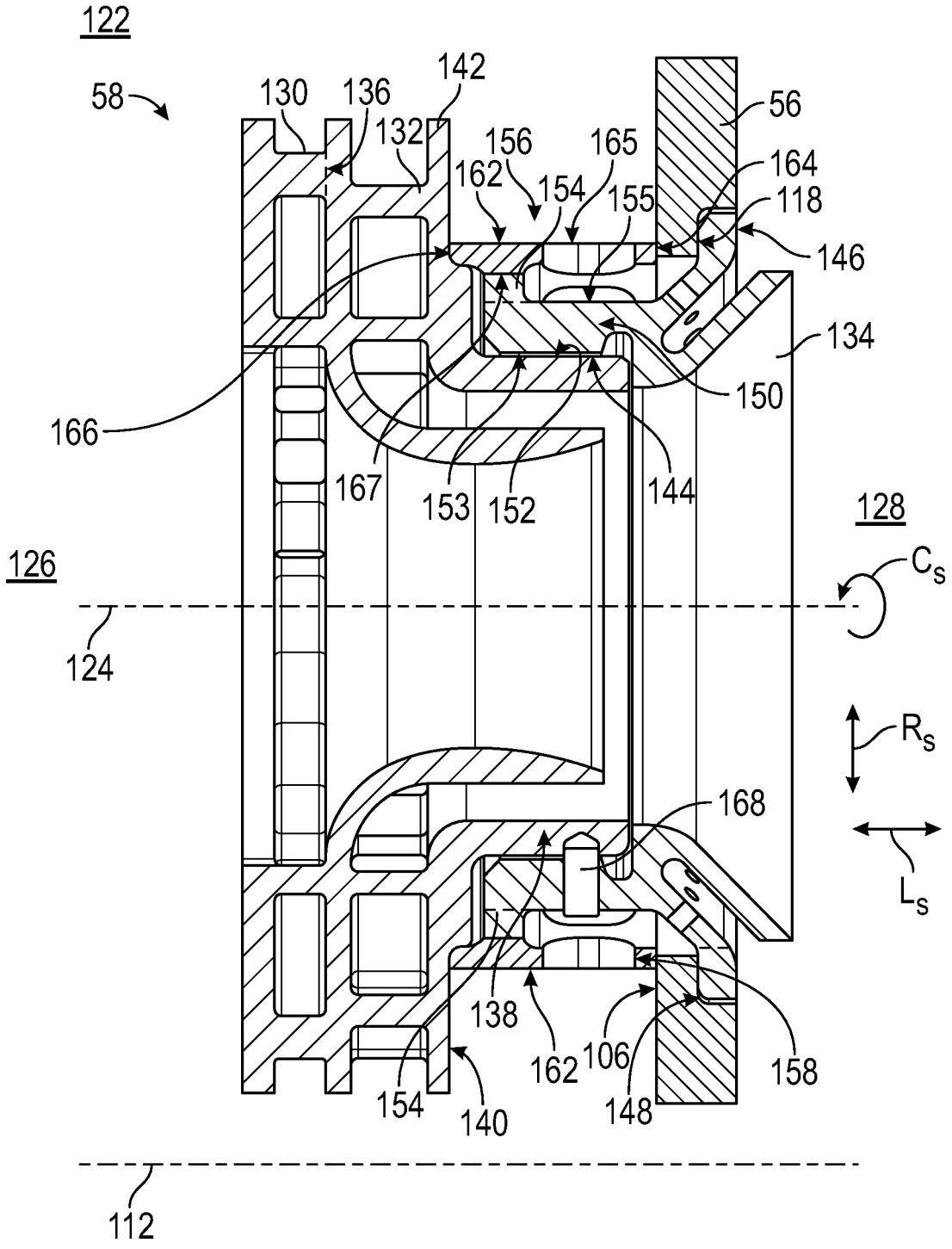
FIG. 4 is a partial cross-sectional side view of a swirler to CMC dome connection, taken at detail view 122 of FIG. 2, according to an aspect of the present disclosure.

FIG. 4 is a partial cross-sectional side view of a swirler to dome attachment, taken at detail view 122 of FIG. 2, according to an aspect of the present disclosure. The swirler assembly 58 defines a swirler centerline axis 124 extending therethrough in a swirler longitudinal direction (Ls). A swirler upstream direction 126 and a swirler downstream direction 128 are defined on either end of the swirler centerline axis 124, and a swirler circumferential direction (Cs) extends about the swirler centerline axis 124. A swirler radial direction (Rs) is defined extending outward from the swirler centerline axis 124. The swirler assembly 58 is seen to include a primary swirler 130, a secondary swirler 132 connected to a downstream side 136 of the primary swirler 130, and a flare 134. The secondary swirler 132 includes a flare attachment wall 138 that extends circumferentially about the swirler centerline axis 124 and extends in the swirler downstream direction 128 from a downstream side 140 of a secondary swirler downstream radial wall 142. The flare attachment wall 138 includes a threaded flare attachment portion 144 constituting a threaded outer surface of the flare attachment wall 138.

Figure 5:
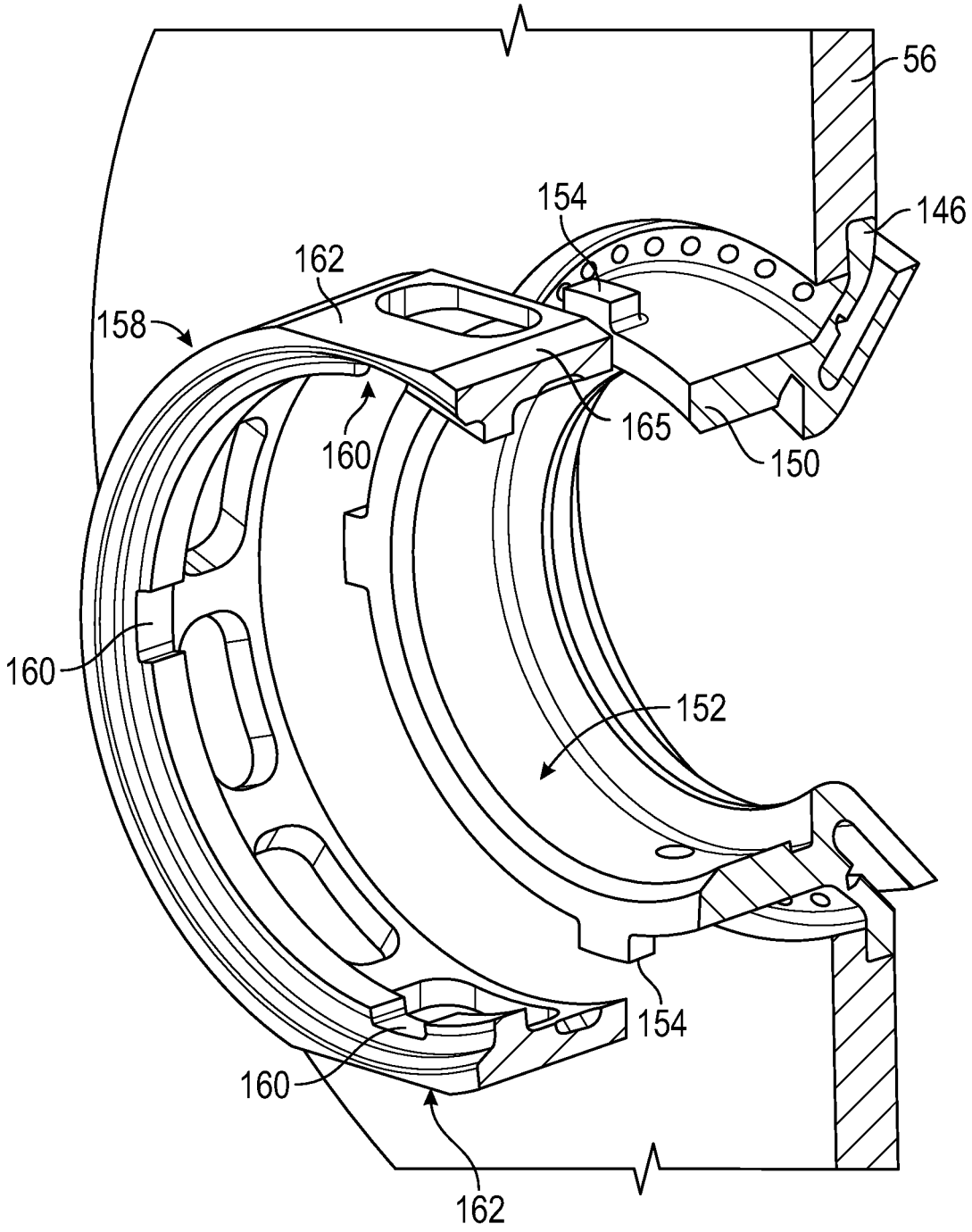
FIG. 5 is a forward aft-looking partial cut-away expanded perspective view of a dome-flare-spacer arrangement, according to an aspect of the present disclosure.

The flare 134 includes a dome interface wall 146 that extends circumferentially about the swirler centerline axis 124, and extends in the swirler radial direction Rs. The dome interface wall 146 includes an upstream surface 148 that, as will be described below, interfaces with the flare interface surface 118 of the CMC dome 56. The flare 134 also includes an annular flare axial wall 150 that extends circumferentially about the swirler centerline axis 124 and extends in the swirler longitudinal direction Ls. The annular flare axial wall 150 includes a threaded secondary swirler attachment portion 152 constituting a threaded inner surface 153 of the annular flare axial wall 150. The annular flare axial wall 150 includes a plurality of spacer engagement members 154 extending radially outward from an outer surface 155 of the annular flare axial wall 150. The plurality of spacer engagement members 154 can also be seen in FIG. 5, which is a forward aft-looking partial cut-away perspective view depicting the flare 134 in relation to the CMC dome 56.

The combustor 26 further includes, as part of connecting the swirler assembly 58 with the CMC dome 56, a swirler-dome attachment member 156. In the present aspect of the disclosure shown in FIG. 4, the swirler-dome attachment member 156 is seen to be a spacer 158 arranged between the secondary swirler downstream radial wall 142 of the secondary swirler 132 and the upstream surface 106 of the CMC dome 56. The spacer 158 is seen to be an annular ring that extends circumferentially about the swirler centerline axis 124, and includes a plurality of flare engagement slots 160 (see FIG. 5) on an inner surface 167 of the spacer 158 that engage with respective ones of the plurality of spacer engagement members 154 of the flare 134. The spacer 158 is also seen to include a plurality of lands 162 (i.e., flat surfaces) on an outer surface 165 (see also, FIG. 5) of the spacer 158.

Figure 6:
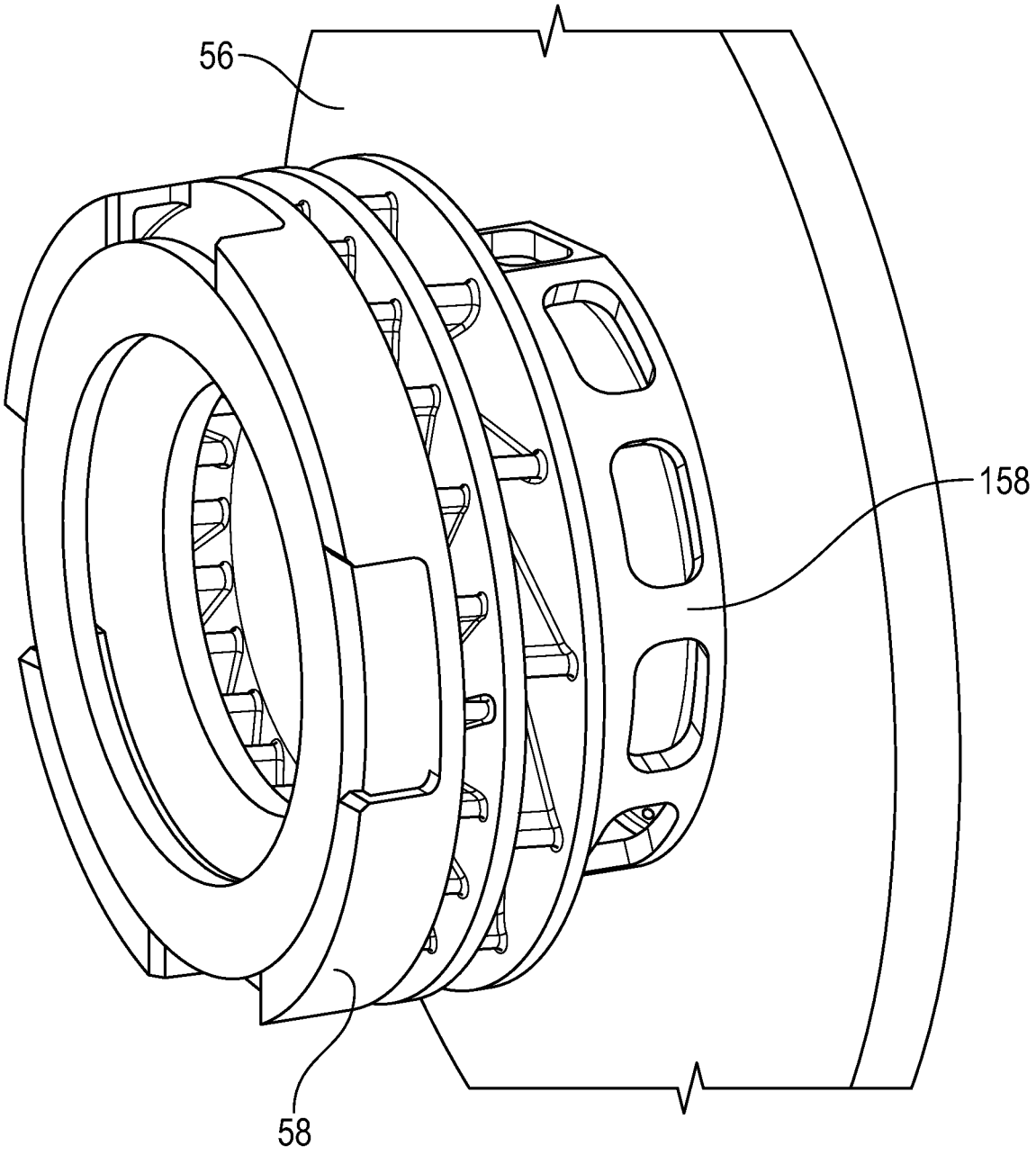
FIG. 6 is a forward aft-looking perspective view of a swirler assembly and CMC dome connection, according to an aspect of the present disclosure.

In connecting the swirler assembly 58 to the CMC dome 56, the flare 134 is inserted into the swirler opening 100 of the CMC dome 56, with the dome interface wall inserted into the recess 108 to abut against the shoulder 110. The spacer 158 is then installed over the flare 134 to abut against the upstream surface 106 of the CMC dome 56. The flare engagement slots 160 (FIG. 5) are arranged to engage with respective ones of the spacer engagement members 154 of the flare 134. A restraining mechanism (not shown) engages each of the plurality of lands 162 to restrain the spacer 158 and the flare 134 from rotating within the swirler opening 100. The secondary swirler 132, with the primary swirler 130 already being connected thereto, is then threadedly engaged with the flare 134 such that the threaded flare attachment portion 144 of the secondary swirler 132 engages the threaded secondary swirler attachment portion 152 of the flare 134. As the secondary swirler 132 is threadedly engaged with the flare 134, a downstream end 164 of the spacer 158 engages with the upstream surface 106 of the CMC dome, and an upstream end 166 of the spacer 158 engages with the secondary swirler downstream radial wall 142. A predetermined amount of torque is applied to the secondary swirler 132 so that the spacer 158 (i.e., the swirler-dome attachment member 156) applies a compression force to the CMC dome 56 to engage the dome interface wall 146 and the flare interface surface 118 (i.e., the shoulder 110) so as to connect the CMC dome 56 and the swirler assembly 58. An anti-rotation retention member 168 may then be installed through the annular flare axial wall 150 to engage the flare attachment wall 138 of the secondary swirler 132 to retain the threaded engagement between the secondary swirler 132 and the flare 134, and correspondingly, to retain the applied force between the dome interface wall 146 and the flare interface surface 118 of the CMC dome 56. FIG. 6 is a forward aft-looking perspective view depicting the swirler assembly 58 after having been connected to the CMC dome 56 per the foregoing description.

Figure 7:
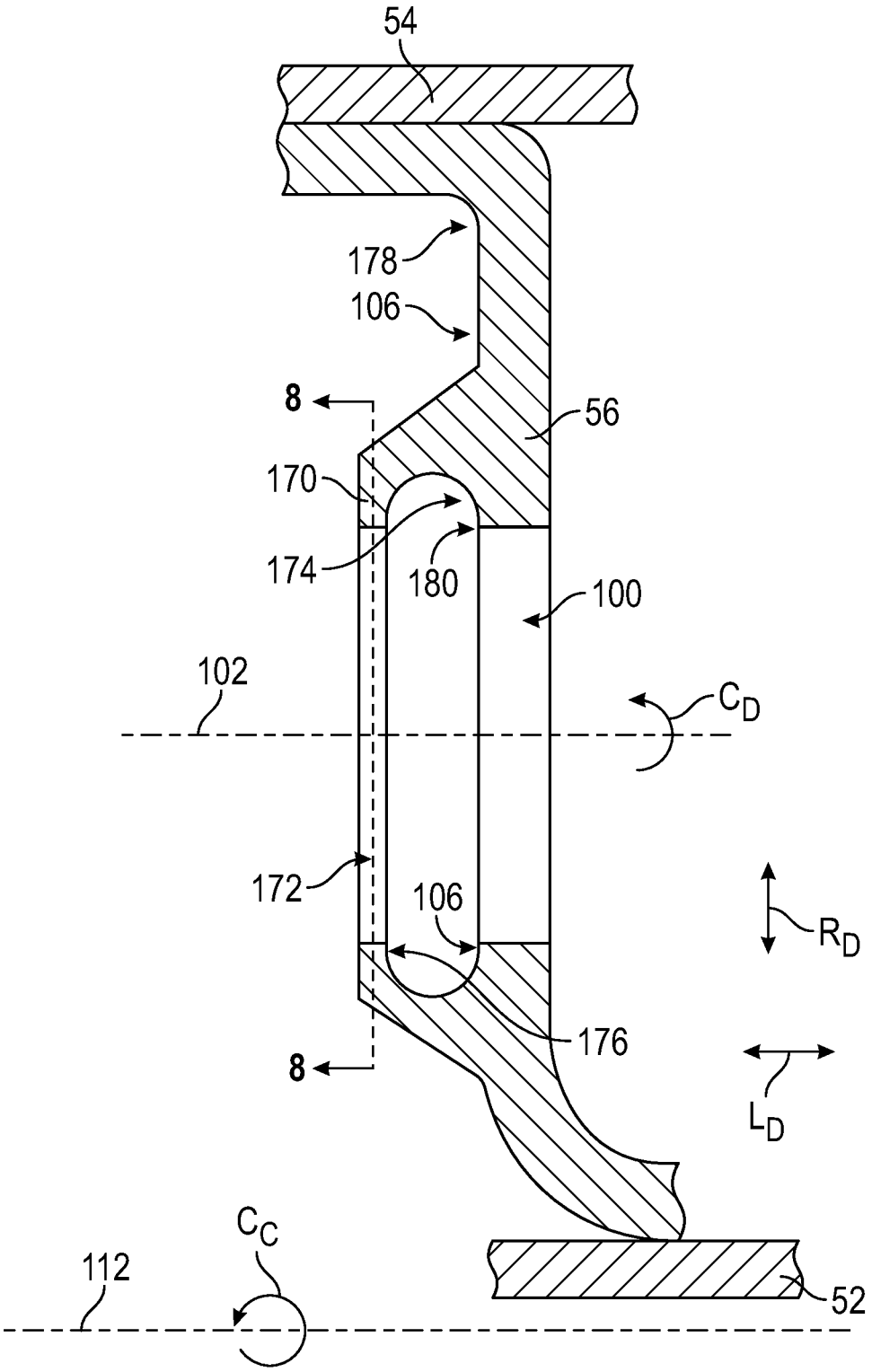
FIG. 7 is a partial cross-sectional side view of an exemplary CMC dome structure, according to another aspect of the present disclosure.

FIG. 7 is a partial cross-sectional side view of a CMC dome according to another aspect of the present disclosure. In FIG. 7, the CMC dome 56 includes a swirler mounting wall 170 arranged on an upstream side 178 of the CMC dome 56 and extending circumferentially about the CMC opening centerline 102. The swirler mounting wall 170 has a second swirler opening 172 therethrough. An annular cavity 174 is defined between the upstream surface 106 of the CMC dome 56 and a downstream surface 176 of the swirler mounting wall 170. The upstream surface 106 of the CMC dome 56 surrounding the swirler opening 100 may be seen to correspond to a flare interface surface 180.

Figure 8:
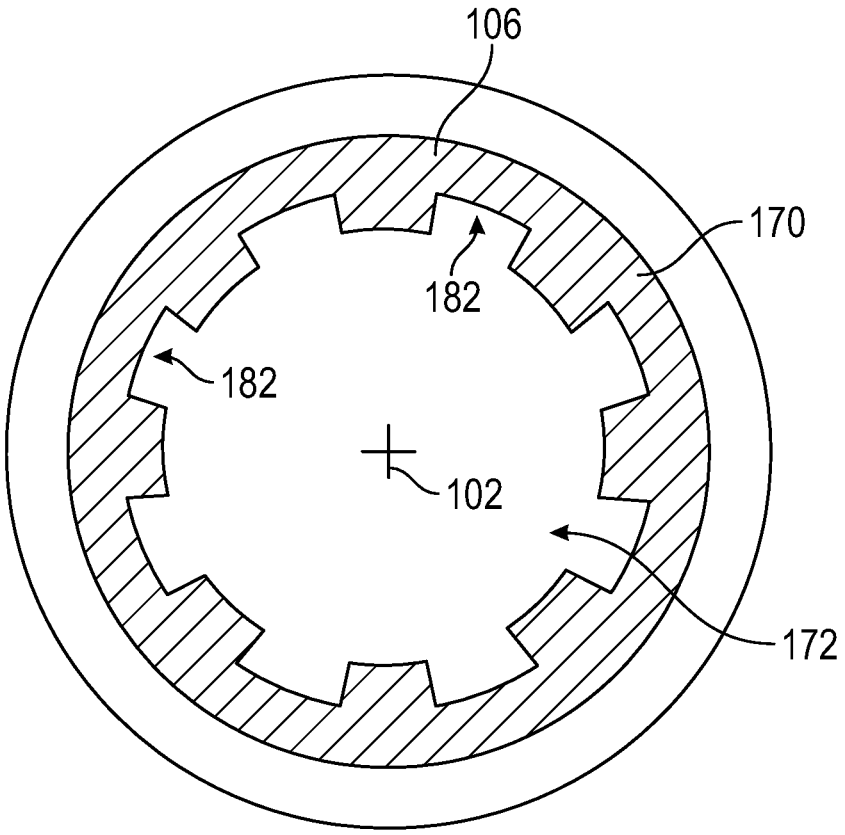
FIG. 8 is a cross section of a swirler mounting wall taken at plane 8-8 of FIG. 7, according to an aspect of the present disclosure.

FIG. 8 is a cross section through the swirler mounting wall 170 taken at plane 8-8 of FIG. 7. As seen in FIG. 8, the swirler mounting wall 170 includes a plurality of mounting wall slots 182 therethrough, were the plurality of mounting wall slots 182 are circumferentially spaced about the second swirler opening 172. The swirler mounting wall 170 may be formed integral to the CMC dome 56.

Figure 9:
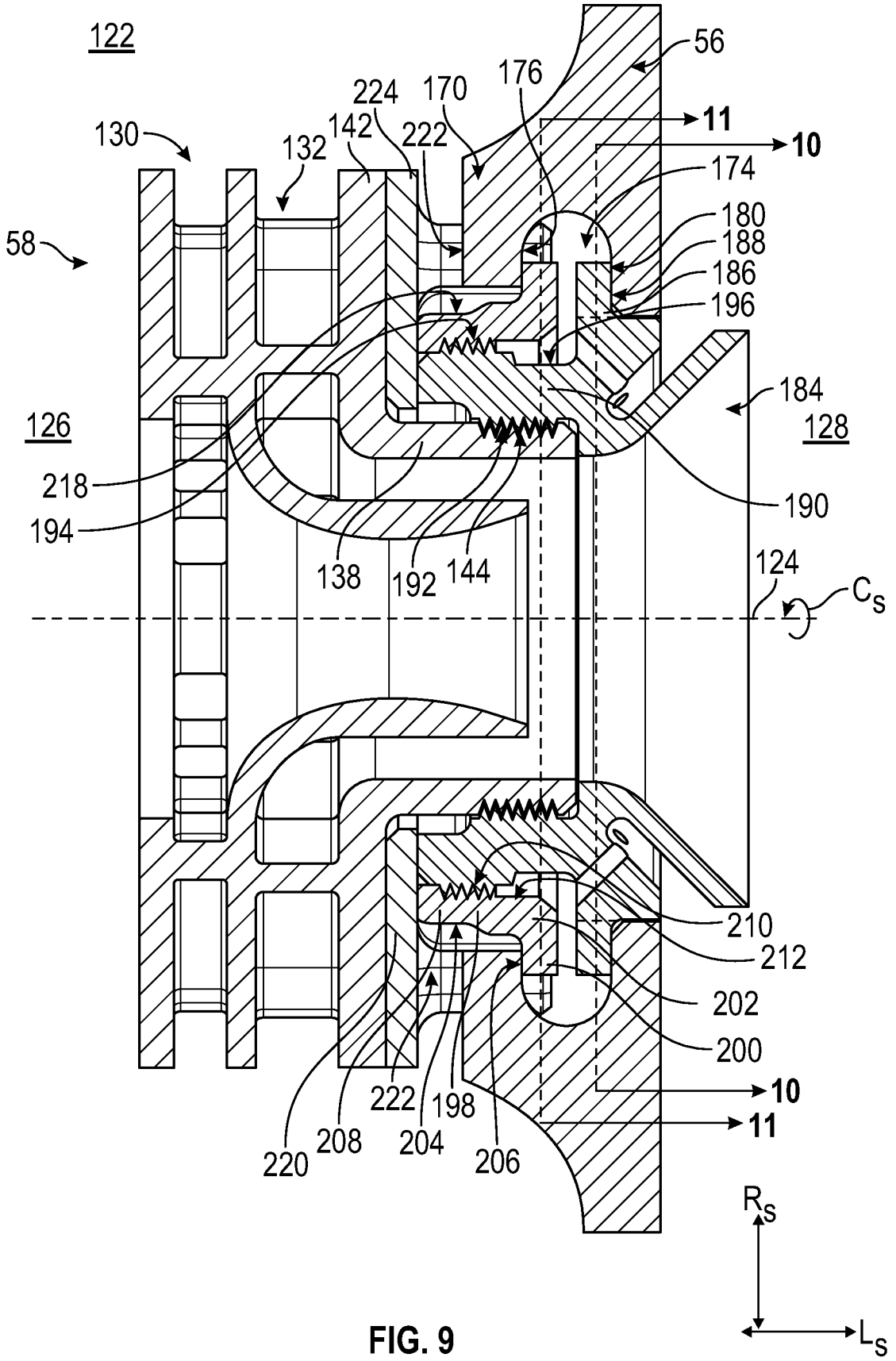
FIG. 9 is a partial cross-sectional side view of a swirler to CMC dome connection, taken at detail view 122 of FIG. 2, according to another aspect of the present disclosure.

FIG. 9 is a partial cross-sectional side view of a swirler to dome attachment, taken at detail view 122 of FIG. 2, according to another aspect of the present disclosure. The swirler assembly 58 of FIG. 9 includes some common components of the swirler assembly 58 of FIG. 4, including the primary swirler 130 and secondary swirler 132. Thus, the common components having the same reference numerals as those of FIG. 4 will not be described again. In the FIG. 9 aspect, however, the swirler assembly 58 is connected to the CMC dome 56 of FIGS. 7 and 8. The swirler assembly 58 of FIG. 9 includes a flare 184 that is connected to the secondary swirler 132. The flare 184 includes a dome interface wall 186 that extends circumferentially about the swirler centerline axis 124, and extends in the swirler radial direction Rs.

Figure 10:
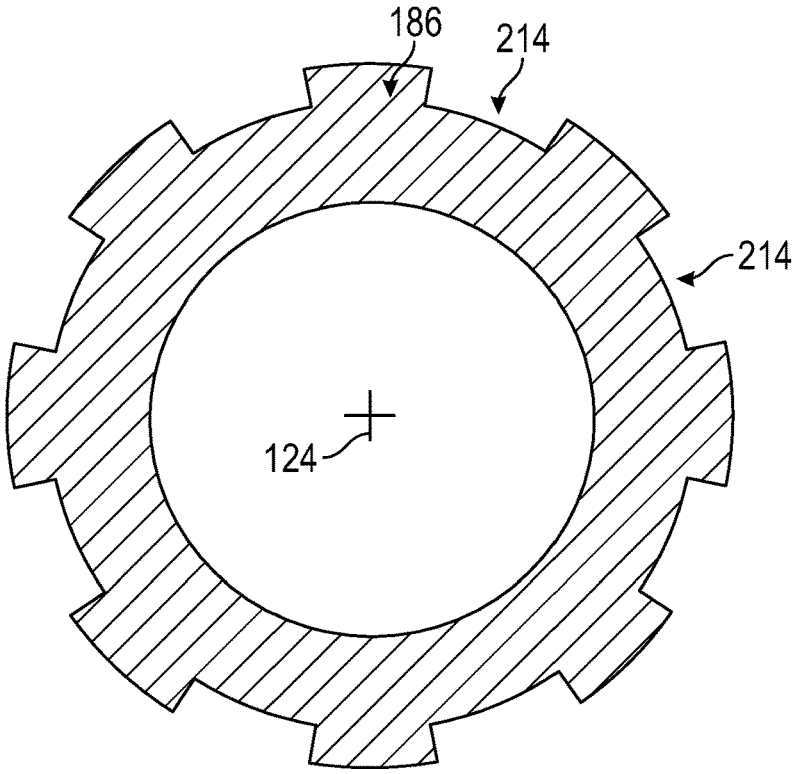
FIG. 10 is a cross section of a dome interface wall, taken at plane 10-10 of FIG. 9, according to an aspect of the present disclosure.

Referring to FIG. 10, which is a cross section taken at plane 10-10 of FIG. 9, the dome interface wall 186 is seen to include a plurality of interface wall slots 214 that are circumferentially spaced about the dome interface wall 186.

Referring again to FIG. 9, the dome interface wall 186 includes a downstream surface 188 that, as will be described below, interfaces with the flare interface surface 180 of the CMC dome 56. The flare 184 also includes an annular flare axial wall 190 that extends circumferentially about the swirler centerline axis 124 and extends in the swirler longitudinal direction Ls. The annular flare axial wall 190 includes a threaded secondary swirler attachment portion 192 constituting a threaded inner surface of the annular flare axial wall 190. The threaded secondary swirler attachment portion 192 may be the same as the threaded secondary swirler attachment portion 152 of FIG. 4. The annular flare axial wall 190 also includes a threaded swirler-dome attachment member portion 194 constituting a threaded outer surface of the annular flare axial wall 190, arranged on an outer surface 196 of the annular flare axial wall 190.

The combustor 26 of the present aspect further includes, as part of connecting the swirler assembly 58 with the CMC dome 56, a swirler-dome attachment member 198. The swirler-dome attachment member 198 includes an attachment member annular axial wall 208 that extends circumferentially about the swirler centerline axis 124, and incudes a threaded flare engagement portion 210 on an inner surface 212 thereof. In the present aspect of the disclosure shown in FIG. 9, the swirler-dome attachment member 198 is essentially a ring (or nut) that threadedly engages the threaded swirler-dome attachment member portion 194 (i.e., the threads) of the flare 184. The swirler-dome attachment member 198 includes a downstream attachment wall 200 disposed at a downstream end 202 of the attachment member annular axial wall 208. The downstream attachment wall 200 extends circumferentially about the swirler centerline axis 124, and extends radially outward from an outer surface 204 of the attachment member annular axial wall 208.

Figure 11:
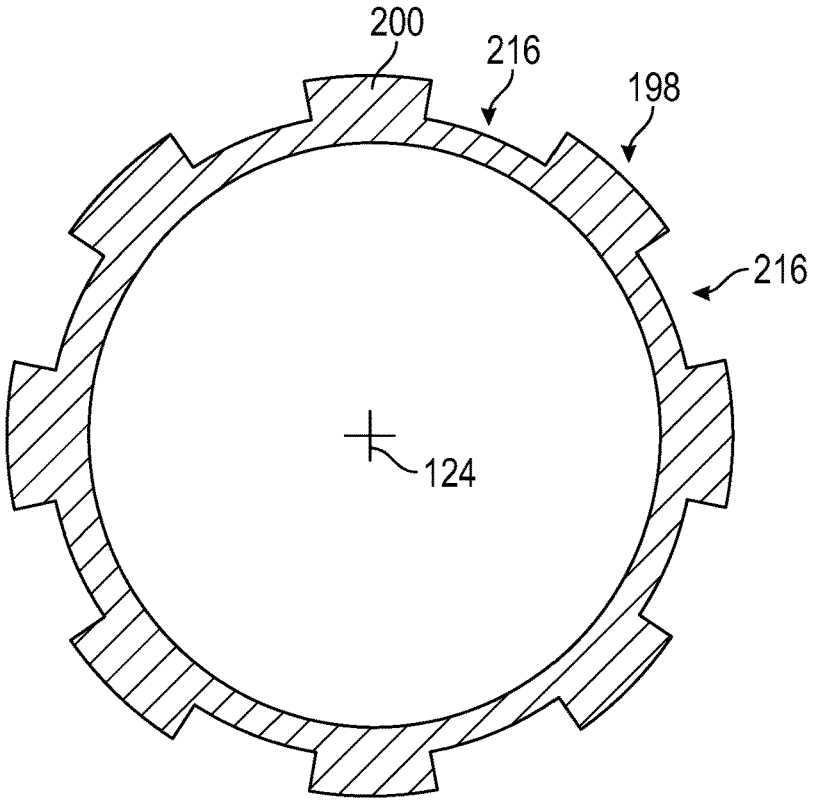
FIG. 11 is a cross section of a downstream attachment wall, taken at plane 11-11 of FIG. 9, according to an aspect of the present disclosure.

Referring to FIG. 11, which is a cross section through the swirler-dome attachment member 198 taken at plane 11-11 of FIG. 9, the downstream attachment wall 200 is seen to include a plurality of attachment member slots 216. The attachment member slots 216 are circumferentially spaced about the swirler centerline axis 124.

Referring back to FIG. 9, The swirler-dome attachment member 198 may also include a plurality of lands 218 for restraining the swirler-dome attachment member 198 during connection of the swirler assembly 58 to the CMC dome 56. As will be described below, in connecting the swirler assembly 58 to the CMC dome 56, an upstream surface 206 of the downstream attachment wall 200 engages with the downstream surface 176 of the swirler mounting wall 170 on the CMC dome 56.

Figure 12:
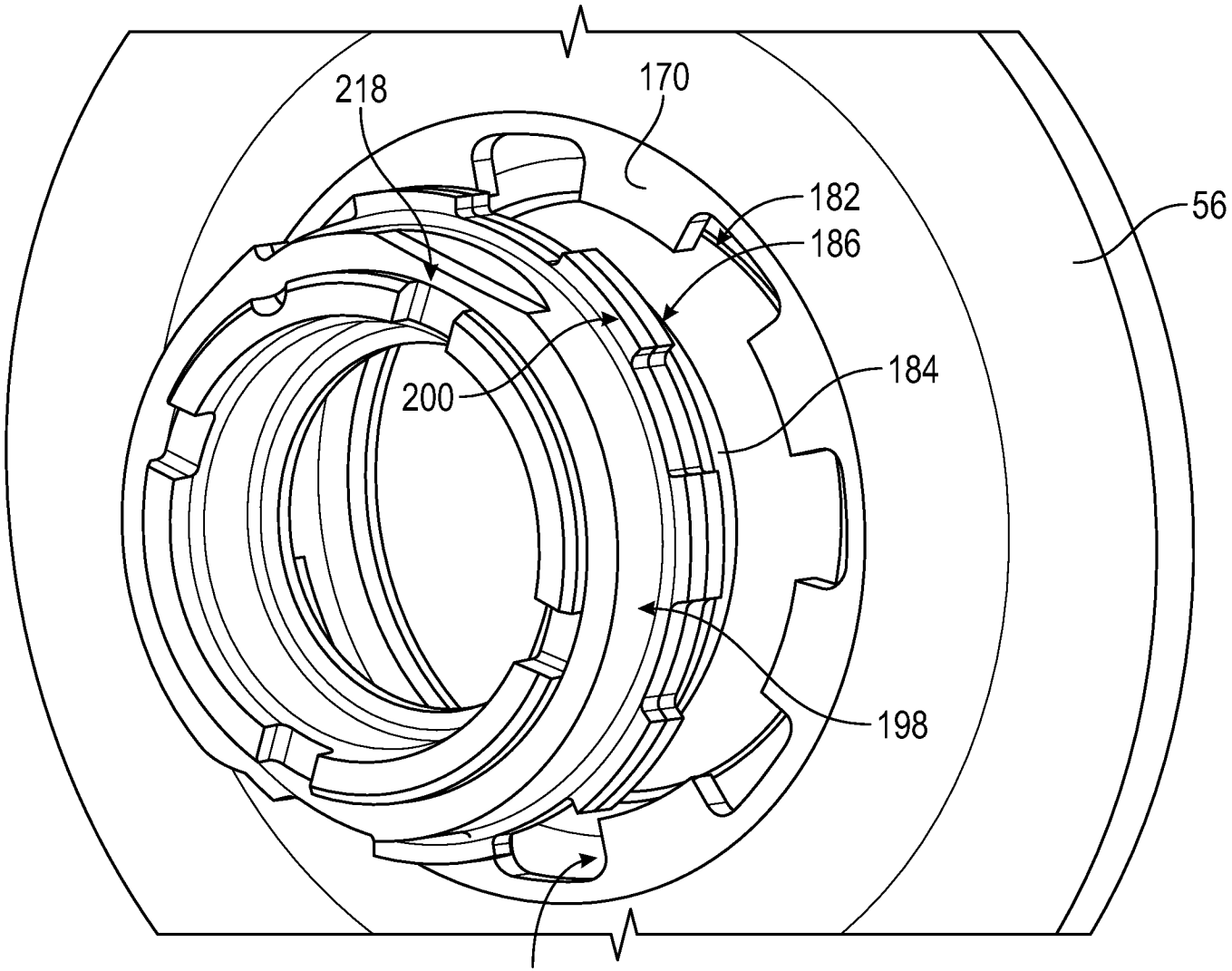
FIG. 12 is a forward aft-looking expanded perspective view of a dome and flare insertion, according to an aspect of the present disclosure.

In connecting the swirler assembly 58 to the CMC dome 56 according to the present aspect of the disclosure, the swirler-dome attachment member 198 is attached to the flare 184. More specifically, the threaded flare engagement portion 210 of the swirler-dome attachment member 198, and the threaded swirler-dome attachment member portion 194 of the flare 184 are threadedly engaged with one another until the dome interface wall 186 of the flare 184 and the downstream attachment wall 200 of the swirler-dome attachment member 198 are in contact with one another. The plurality of interface wall slots 214 of the dome interface wall 186, and the plurality of attachment member slots 216 are aligned with one another (see, FIG. 12). Then, the dome interface wall 186 and the downstream attachment wall 200 are, together, engaged through the plurality of mounting wall slots 182 in the swirler mounting wall 170 such that the dome interface wall 186 and the downstream attachment wall 200 of the swirler-dome attachment member 198 are arranged within the annular cavity 174. The swirler-dome attachment member 198 is then rotated such that the upstream surface 206 of the downstream attachment wall 200 engages with the downstream surface 176 of the swirler mounting wall 170, and the attachment member slots 216 are aligned with the mounting wall slots 182.

Utilizing the plurality of lands 218, the swirler-dome attachment member 198 is restrained from rotating and the flare 184 is rotated about the swirler centerline axis 124 to expand a distance between the downstream attachment wall 200 and the dome interface wall 186. A predetermined amount of torque is applied to the flare 184 so as to provide a predetermined force between the swirler-dome attachment member 198 and the swirler mounting wall 170, and between the dome interface wall 186 and the flare interface surface 180 of the CMC dome 56. That is, the swirler-dome attachment member 198 engages the downstream surface 176 of the swirler mounting wall 170 within the annular cavity 174 to provide a first axial force between the swirler-dome attachment member 198 and the swirler mounting wall 170, and the dome interface wall 186 engages the flare interface surface 180 of the CMC dome 56 within the annular cavity 174 to provide a second axial force between the dome interface wall 186 and the flare interface surface 180 of the CMC dome 56. The first axial force and the second axial force are in opposite directions to one another.

Figure 13:
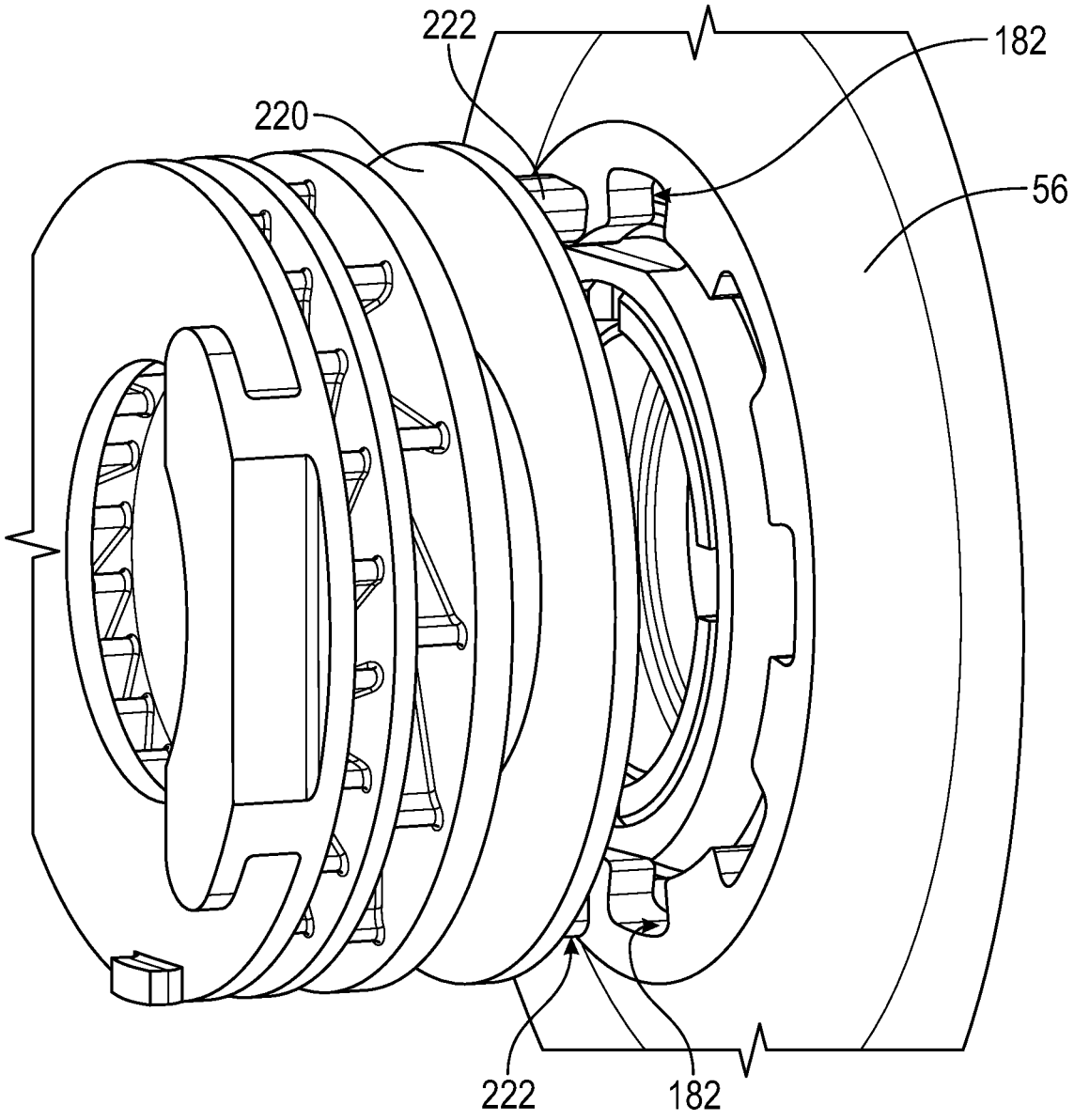
FIG. 13 is a forward aft-looking expanded perspective view of a swirler to dome connection, according to an aspect of the present disclosure.

Referring back to FIG. 9, once the flare 184 and the swirler-dome attachment member 198 are connected to the CMC dome 56 and are torqued to apply the first axial force and the second axial force, an anti-rotation retainer 220 is installed. The anti-rotation retainer 220 is essentially an annular disc 224 that extends circumferentially about the swirler centerline axis 124. The anti-rotation retainer 220 includes a plurality of retention posts 222 that extend axially toward the swirler downstream direction 128 from the annular disc 224. The retention posts 222 are inserted into respective mounting wall slots 182 of the swirler mounting wall 170 (see FIG. 13) so as to restrain the swirler-dome attachment member 198 from rotating after the flare 184 has been torqued. The secondary swirler 132, with the primary swirler 130, is then connected to the flare 184 by threadedly engaging the threaded flare attachment portion 144 of the secondary swirler 132 and the threaded secondary swirler attachment portion 192 of the flare 184. Thus, the swirler assembly 58 is connected to the CMC dome 56.

While the foregoing description relates generally to a gas turbine engine, it can readily be understood that the gas turbine engine may be implemented in various environments. For example, the engine may be implemented in an aircraft, but may also be implemented in non-aircraft applications, such as power generating stations, marine applications, or oil and gas production applications. Thus, the present disclosure is not limited to use in aircraft.

Further aspects of the present disclosure are provided by the subject matter of the following clauses.

A combustor for a gas turbine, the combustor comprising a ceramic matrix composite (CMC) dome including a swirler opening therethrough with a flare interface surface surrounding the swirler opening, a swirler assembly including (a) a secondary swirler having a threaded flare attachment portion, and (b) a flare having (i) a threaded secondary swirler attachment portion, and (ii) a dome interface wall that interfaces with the flare interface surface of the CMC dome, the flare being connected to the secondary swirler via the threaded flare attachment portion and the threaded secondary swirler attachment portion; and a swirler-dome attachment member, the swirler-dome attachment member applying a force to the CMC dome to engage the dome interface wall and the flare interface surface so as to connect the CMC dome and the swirler assembly.

The combustor according to any preceding clause, wherein the swirler assembly further comprises a primary swirler, the secondary swirler being connected to a downstream side of the primary swirler.

The combustor according to any preceding clause, wherein the flare interface surface comprises a recess extending upstream from a downstream surface of the CMC dome and defining a shoulder extending radially outward from the swirler opening, and the dome interface wall engages the shoulder.

The combustor according to any preceding clause, wherein the swirler-dome attachment member comprises a spacer arranged between an upstream surface of the CMC dome, and a downstream radial wall of the secondary swirler.

The combustor according to any preceding clause, wherein the threaded flare attachment portion of the secondary swirler and the threaded secondary swirler attachment portion of the flare are threadedly engaged to apply a force by the spacer against the upstream surface of the CMC dome, thereby exerting a compression force between the shoulder and the dome interface wall of the flare.

The combustor according to any preceding clause, wherein the flare comprises an annular flare axial wall extending circumferentially about a swirler centerline axis, the threaded secondary swirler attachment portion being arranged on an inner surface of the annular flare axial wall.

The combustor according to any preceding clause, wherein the annular flare axial wall includes a plurality of spacer engagement members extending radially outward from an outer surface of the annular flare axial wall.

The combustor according to any preceding clause, wherein the spacer extends circumferentially about the swirler centerline axis, and the spacer includes a plurality of flare engagement slots arranged on an inner surface of the spacer, respective ones of the plurality of flare engagement slots engaging with respective ones of the plurality of spacer engagement members of the annular flare axial wall.

The combustor according to any preceding clause, further comprising an anti-rotation retention member disposed through the flare and engaging the secondary swirler to retain threaded engagement of the flare and the secondary swirler.

The combustor according to any preceding clause, wherein the CMC dome further comprises a swirler mounting wall arranged on an upstream side of the CMC dome and extending circumferentially about a centerline axis of the swirler opening, the swirler mounting wall having a second swirler opening therethrough, an annular cavity being defined between an upstream surface of the CMC dome and a downstream surface of the swirler mounting wall.

The combustor according to any preceding clause, wherein the swirler mounting wall is formed integral with the CMC dome.

The combustor according to any preceding clause, wherein the upstream surface of the CMC dome surrounding the swirler mounting opening comprises the flare interface surface, and the dome interface wall of the flare interfaces with the upstream surface of the CMC dome.

The combustor according to any preceding clause, wherein the flare comprises an annular flare axial wall extending circumferentially about a swirler centerline axis, the threaded secondary swirler attachment portion being arranged on an inner surface of the annular flare axial wall, the annular flare axial wall further comprising a threaded swirler-dome attachment member portion arranged on an outer surface of the annular flare axial wall.

The combustor according to any preceding clause, wherein the swirler-dome attachment member comprises an attachment member annular axial wall that extends circumferentially about the swirler centerline axis, and includes a threaded flare engagement portion on an inner surface thereof.

The combustor according to any preceding clause, wherein the swirler-dome attachment member includes a downstream attachment wall extending radially outward from a downstream end of the attachment member annular axial wall, the downstream attachment wall including a plurality of attachment member slots therethrough.

The combustor according to any preceding clause, wherein the dome interface wall includes a plurality of interface wall slots therethrough, and the swirler mounting wall of the CMC dome including a plurality of mounting wall slots therethrough.

The combustor according to any preceding clause, wherein the swirler-dome attachment member engages the downstream surface of the swirler mounting wall within the annular cavity to provide a first axial force between the swirler-dome attachment member and the swirler mounting wall, and the dome interface wall engages the upstream surface of the CMC dome within the annular cavity to provide a second axial force between the dome interface wall and the upstream surface of the CMC dome, the first axial force and the second axial force being in opposite directions to one another.

The combustor according to any preceding clause, wherein, during assembly, the threaded flare engagement portion of the swirler-dome attachment member, and the threaded swirler-dome attachment member portion of the flare are threadedly engaged with one another, the plurality of interface wall slots of the dome interface wall, and the plurality of attachment member slots are aligned and, together, the dome interface wall and the downstream attachment wall are engaged through the plurality of mounting wall slots such that the dome interface wall and the downstream attachment wall of the swirler-dome attachment member are arranged within the annular cavity, the swirler-dome attachment member is rotated such that an upstream surface of the downstream attachment wall engages with the downstream surface of the swirler mounting wall, and while restraining the swirler-dome attachment member from rotating, the flare is rotated about the swirler centerline axis to expand a distance between the downstream attachment wall and the dome interface wall so as to provide a predetermined compression force between the swirler-dome attachment member and the swirler mounting wall, and between the dome interface wall and the upstream surface of the CMC dome.

The combustor according to any preceding clause, further comprising an anti-rotation retainer having a plurality of retention posts extending axially therefrom, the plurality of retention posts engaging through respective ones of the plurality of mounting wall slots so as to retain the swirler-dome attachment member with the CMC dome.

The combustor according to any preceding clause, wherein the anti-rotation retainer comprises an annular disc extending circumferentially about the swirler centerline axis, and the plurality of retention posts extend in a downstream direction from the annular disc.

Although the foregoing description is directed to some exemplary embodiments of the present disclosure, other variations and modifications will be apparent to those skilled in the art, and may be made without departing from the spirit or scope of the disclosure. Moreover, features described in connection with one embodiment of the present disclosure may be used in conjunction with other embodiments, even if not explicitly stated above.

We claim:

1. A combustor for a gas turbine, the combustor comprising:

a ceramic matrix composite (CMC) dome including a swirler opening therethrough with a flare interface surface surrounding the swirler opening on an upstream surface of the CMC dome, the CMC dome further including a swirler mounting wall arranged on an upstream side of the CMC dome and extending circumferentially about a centerline axis of the swirler opening, the swirler mounting wall having a second swirler opening therethrough, an annular cavity being defined between the upstream surface of the CMC dome and a downstream surface of the swirler mounting wall;

a swirler assembly including (a) a primary swirler, (b) a secondary swirler having a threaded flare attachment portion, and (c) a flare having (i) a threaded secondary swirler attachment portion, (ii) a dome interface wall that interfaces with the flare interface surface of the CMC dome, and (iii) a threaded swirler-dome attachment member portion; and a swirler-dome attachment member including a threaded flare engagement portion and an attachment wall, wherein, the dome interface wall of the flare and the attachment wall of the swirler-dome attachment member are arranged within the annular cavity, and the swirler-dome attachment member is threadedly engaged with the threaded swirler-dome attachment member portion of the flare so as to cause the dome interface wall of the flare to engage the flare interface surface of the CMC dome with a first axial force being applied therebetween, and so as to cause the attachment wall of the swirler-dome attachment member to engage with the downstream surface of the swirler mounting wall with a second axial force being applied therebetween.

2. The combustor according to claim 1, wherein the swirler mounting wall is formed integral with the CMC dome.

3. The combustor according to claim 1, wherein the flare comprises an annular flare axial wall extending circumferentially about the centerline axis of the swirler opening, the threaded secondary swirler attachment portion being arranged on an inner surface of the annular flare axial wall, the annular flare axial wall further comprising a threaded swirler-dome attachment member portion arranged on an outer surface of the annular flare axial wall.

4. The combustor according to claim 3, wherein the swirler-dome attachment member comprises an attachment member annular axial wall that extends circumferentially about the centerline axis of the swirler opening, and includes the threaded flare engagement portion on an inner surface thereof.

5. The combustor according to claim 4, wherein the attachment wall extends radially outward from a downstream end of the attachment member annular axial wall, the attachment wall including a plurality of attachment member slots therethrough.

6. The combustor according to claim 5, wherein the dome interface wall includes a plurality of interface wall slots therethrough, and the swirler mounting wall of the CMC dome including a plurality of mounting wall slots therethrough.

7. The combustor according to claim 1, wherein the first axial force and the second axial force are in opposite directions to one another.

8. The combustor according to claim 6, wherein, during assembly, the threaded flare engagement portion of the swirler-dome attachment member, and the threaded swirler-dome attachment member portion of the flare are threadedly engaged with one another, the plurality of interface wall slots of the dome interface wall, and the plurality of attachment member slots are aligned and, together, the dome interface wall and the attachment wall are engaged through the plurality of mounting wall slots such that the dome interface wall and the attachment wall of the swirler-dome attachment member are arranged within the annular cavity, the swirler-dome attachment member is rotated such that an upstream surface of the attachment wall engages with the downstream surface of the swirler mounting wall, and while restraining the swirler-dome attachment member from rotating, the flare is rotated about the centerline axis of the swirler opening to expand a distance between the attachment wall and the dome interface wall so as to provide a predetermined compression force between the swirler-dome attachment member and the swirler mounting wall, and between the dome interface wall and the upstream surface of the CMC dome.

9. The combustor according to claim 6, further comprising an anti-rotation retainer having a plurality of retention posts extending axially therefrom, the plurality of retention posts engaging through respective ones of the plurality of mounting wall slots so as to retain the swirler-dome attachment member with the CMC dome.

10. The combustor according to claim 9, wherein the anti-rotation retainer comprises an annular disc extending circumferentially about the centerline axis of the swirler opening, and the plurality of retention posts extend in a downstream direction from the annular disc.

* * * * *